United States Patent [19]

Von Schuckmann et al.

[11] Patent Number: 4,763,815

[45] Date of Patent: Aug. 16, 1988

[54] DISPENSER

[75] Inventors: Alfred Von Schuckmann, Kevelaer; Herbert Mettenbrink, Lohne/Oldenburg, both of Fed. Rep. of Germany

[73] Assignee: Bramlage Gesellschaft mit beschrankter Haftung, Lohne/Oldenburg, Fed. Rep. of Germany

[21] Appl. No.: 20,518

[22] Filed: Mar. 2, 1987

[30] Foreign Application Priority Data

Mar. 1, 1986 [DE] Fed. Rep. of Germany ..... 3606711

[51] Int. Cl.[4] ..... B65D 35/30

[52] U.S. Cl. ..... 222/96; 222/105; 222/153; 222/341; 222/391; 221/229

[58] Field of Search ..... 222/95, 103, 105, 391; 401/66, 84, 152; 604/210, 214, 224; 74/130

[56] References Cited

U.S. PATENT DOCUMENTS

| | | | |
|---|---|---|---|
| 2,496,464 | 1/1950 | Lingdell | 222/103 X |
| 2,689,066 | 9/1954 | Budnik | 222/103 |
| 3,255,935 | 6/1966 | Spatz | 222/340 |
| 4,437,584 | 3/1984 | Connors et al. | 222/137 |
| 4,487,341 | 12/1984 | Daykin et al. | 222/391 |

FOREIGN PATENT DOCUMENTS

| | | | |
|---|---|---|---|
| 3036256 | 9/1982 | Fed. Rep. of Germany | 222/391 |
| 850458 | 9/1939 | France . | |
| 2489267 | 3/1982 | France | 222/391 |

*Primary Examiner*—Joseph J. Rolla
*Assistant Examiner*—F. R. Handren
*Attorney, Agent, or Firm*—Collard, Roe & Galgano

[57] ABSTRACT

A dispenser is provided for dispensing unit doses of a substance, such as tablets, pastes and the like having a tubular casing with a discharge opening at one end and a pressure bottom at the other end for the displacement of the discharge substance in the direction of the discharge opening, the pressure bottom being moved step by step in the direction of the discharge opening by the action of an operating handle positioned near the discharge opening and of at least one transport rack, the pressure bottom being blocked against backwards movement by at least one support rack located at the inner wall of the tubular casing, the transport rack and the support rack being mounted on an insert piece of the tube casing.

5 Claims, 6 Drawing Sheets

20
13
13
1
22
33
12
2
13
3
20

DISPENSER

The present invention relates generally to dispensers and, more particularly, to dispensers which dispense single or discrete units or doses of material during each dispensing operation.

A dispenser of the type with which the present invention is concerned is disclosed in unpublished European Patent Application No. 85 115 220.7 of the applicant herein. In the referenced application, the support rack is an integral part of the tubular casing wall while the transport racks, on the other hand, are guided in longitudinal grooves of the tube casing wall. This arrangement leaves the entire inside cross section of the tubular casing available for material to be dispensed. From a production point of view it is, however, desirable that the tubular casing be kept separate, as much as possible, from the devices forming the dispensing mechanism, i.e. to retain the simple, smooth tube form of the dispenser casing.

The primary object of the present invention is to embody a class type dispenser that, with respect to manufacture and assembly, is more advantageous for the advancing mechanism of the pressure bottom without impairing the operational reliability of the dispenser.

The above object is accomplished in accordance with the present invention by mounting the transport racks and support racks on an insert piece of the tubular casing. In this manner, a class type dispenser of simple design is obtained which nevertheless possesses a high service reliability. The racks which act as locking devices are arranged in a separate component of the dispenser. This separate component can be formed like a tubular jacket with a rather thin wall. Assembling the dispenser consists only of inserting and attaching this insert piece, which can be performed automatically. This obviates the need to insert individual transport racks. Furthermore, it is no longer necessary to compromise in the selection of the material, rather, the most suitable material can be used for the respective application. Special guides for the movable transport racks are not required so that advantageously the transport racks and support racks can be connected with one another through crosspieces or bridges. Such a construction presents no problem for injection molding, it is stable and, furthermore, the crosspieces can be arranged as restoring springs, thereby allowing dispensing with the classical separate restoring spring. The number of parts for the dispenser is thereby reduced. Finally, a very user friendly embodiment results because of the ability of the insert piece to move against the spring load in a kind of free play in the direction opposite to the discharge opening. This permits the pressure bottom to retract somewhat after release of the operating handle and thereby relieve tension in the substance being discharged. Thus, with a pasty material, the usual formation at the discharge end of a residue of pasty ribbon does not occur since this leftover ribbon is withdrawn by the small retraction of the pressure bottom. Thus, moisture contact with the remainder of the substance is preserved. A blockage caused by a dried up remainder at the discharge opening is also thereby avoided.

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

Figure 1:
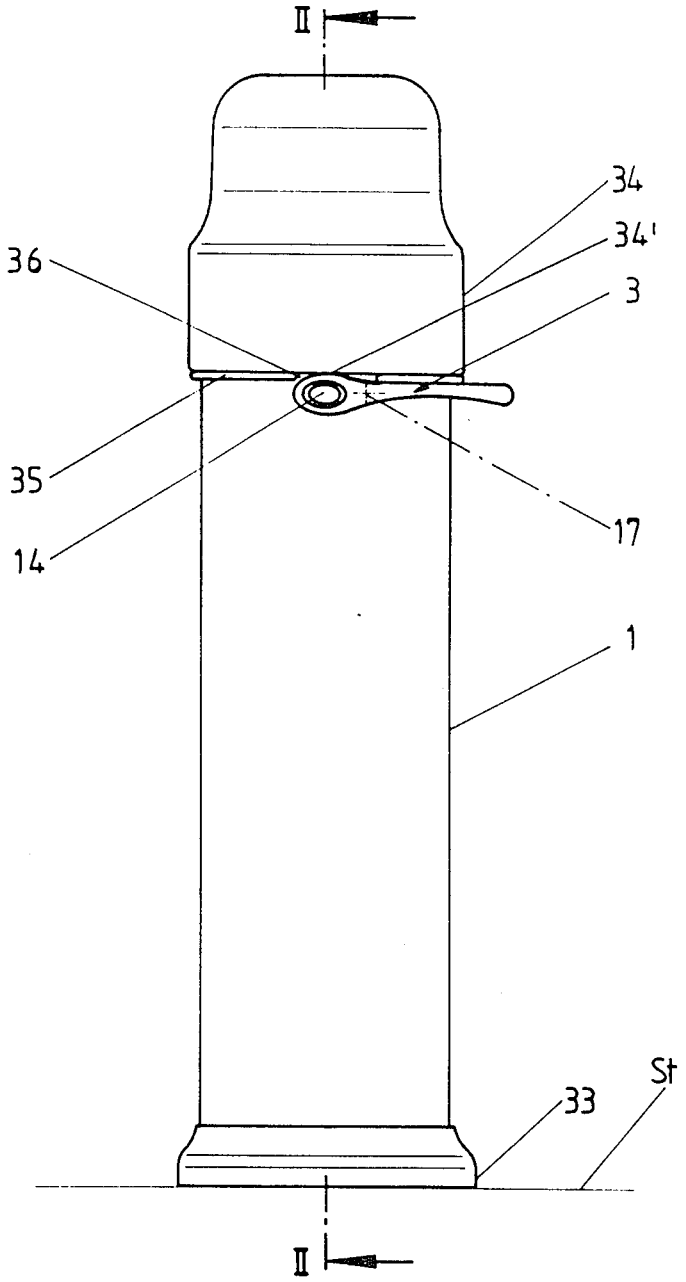
FIG. 1 is a side elevational view of the dispenser of the present invention in the normal locked position.
Figure 2:
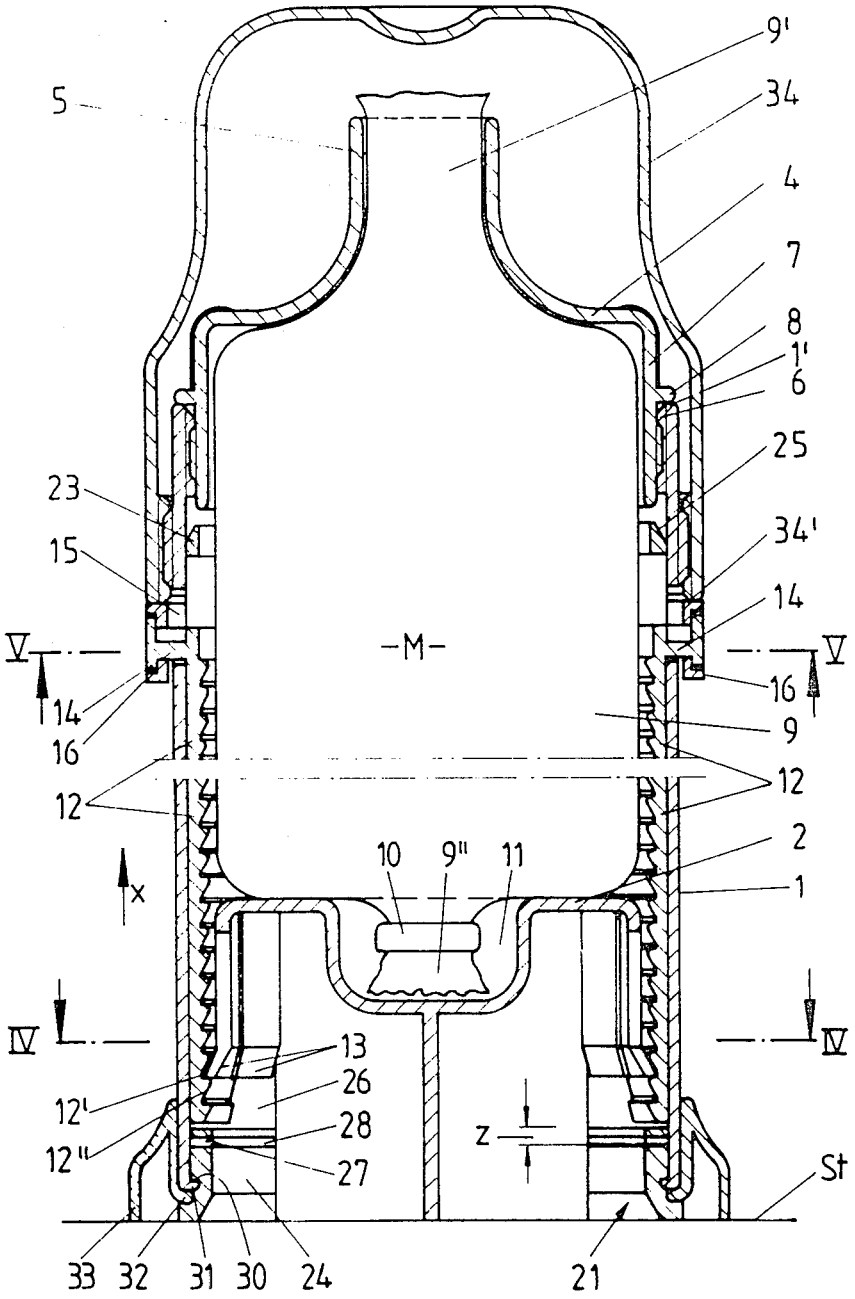
FIG. 2 is a cross-sectional view of the dispenser of FIG. 1 taken along line II—II of FIG. 1.

Now turning to the drawings and particularly FIGS. 1 and 2, therein is shown a dispenser arranged for the discharge of a pasty content which possesses an essentially cylindrical tubular casing 1 terminating at the bottom in a pressure bottom 2 which is inserted from below. By means of operating handle 3, pressure bottom 2 can be moved in steps in the direction of arrow x. At the top, the dispenser is provided with a screwed on cover 4, which is tapered off into the shape of a funnel forming the central discharge opening 5. Cover 4 is threadably engaged with cylindrical tube casing 1, which latter has at its upper rim an internal thread 6 which cooperates with the corresponding outer thread of cap shaped cover 4. The cap side-wall 7 is formed with an outwardly extending lip 8 which, when touching the upper edge 1' of tube casing 1, acts as a limit stop.

Between pressure bottom 2 and cover 4 a bag 9 is arranged which is made from plastic foil or similar material. Bag 9 contains the pasty substance M and is formed like a "sausage" with two tied ends. Bag 9 has a cylindrical shape and is arranged practically upright in dispenser casing 1 leaving an annular clearance at the casing wall. Of the so-called "sausage ends" the upper, pleated end 9' of the bag projects through discharge opening 5 like a spout and is cut off thereabove. The other end of bag 9 is kept closed by a seal 10 and projects into a central recess 11 of pressure bottom 2.

Through the action of the operating handle the pressing out of pasty substance M from bag 9 is effected by an axial traction movement of the two transport racks 12 arranged diametrically opposite each other. Their steep teeth surfaces 12' carry along pressure bottom 2 in the direction of arrow x. For this purpose ratchet teeth 13 protrude from pressure bottom 2. They are formed by a collar of cup shaped pressure bottom 2 which is serrated to form individual, radially movable fingers, the ends of which are bent slightly outwardly and engage with surfaces 12' of transport racks 12. During counter movement, the flatter sides 12'' of transport rack 12 slide freely over ratchet teeth 13.

Figure 5:
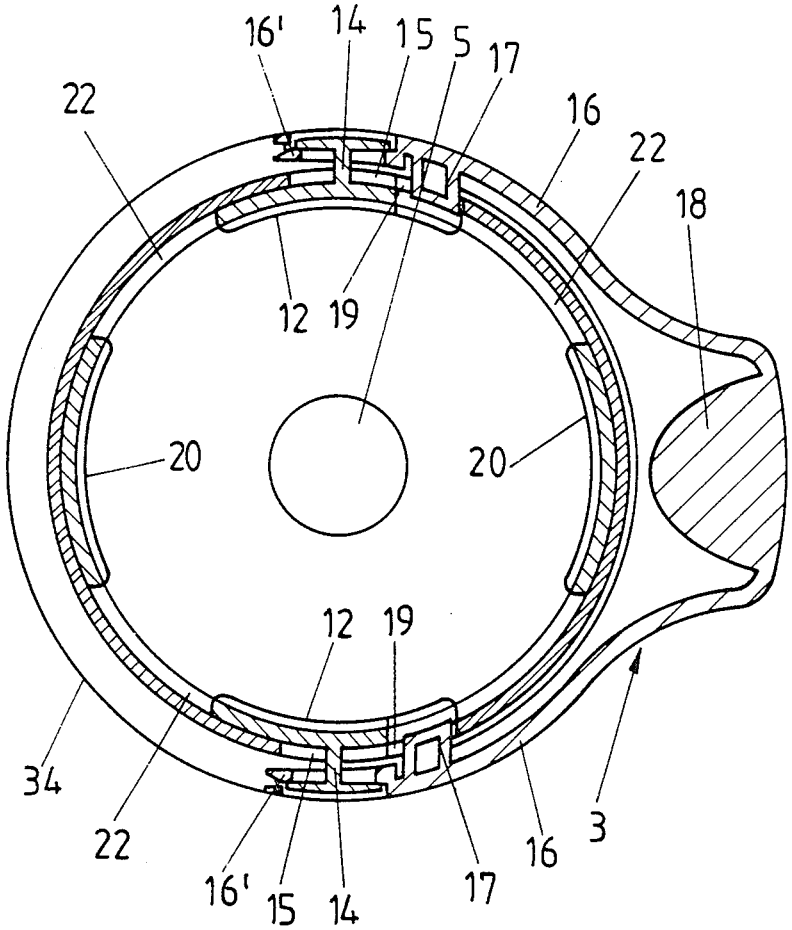
FIG. 5 is a cross-sectional view taken along line V—V of FIG. 2.

From the back of transport racks 12, which are carried or supported along the inner wall of tube casing 1, pins 14 project outwardly penetrating the cylindrical wall of tube casing 1 through openings 15 which are dimensioned to accommodate the maximum displacement stroke of transport rack 12. Operating handle 3, engaging pins 14 of the two transport racks 12 is shaped as a two-arm lever. In order to engage the diametrically oppositely positioned pins 14, the operating handle is bifurcated, as clearly seen in FIG. 5. The two correspondingly arched prongs 16 are supported at counteropposed sites of casing tube 1. The bearings, which are not diametrically oppositely positioned, are indicated by the reference numeral 17. The end section, or shorter arm of the lever, is positioned opposite the sidewise protruding push button 18 of the operating handle and is coupled by an articulated clip connection with pin 14. The free, split end of prongs 16 can be spread apart against the resilience of the material and clipped over the thickened head of pin 14. The head of pin 14 is then enclosed by one vertical jaw, while the opposite located jaw, directed towards tube casing 1 blocks the mounting path with a lip 16'. In order to obtain an adequate non-jamming free play of operating handle 3, a hinge pin 17 of prong 16 engages a recess 19 in the wall of tube casing 1. The recess 19 is selected significantly larger than pin 17 and is substantially shaped like a horizontal longitudinal slot.

Transport racks 12, which are displaced axially by the action of operating handle 3, are connected to support racks 20 which are not included in this movement. The latter have the same serrated construction as transport racks 12, meaning a steep flank 20' arranged perpendicularly to the displacement direction of pressure bottom 2 and a back that can be slid over and is formed by a rather flat flank 20''. The corresponding flanks are aligned in the direction of rotation, that is flank 12' is positioned at the same height in relation to flank 20', etc.

Transport racks 12 and support racks 20, both having the same angular arrangment and axial alignment, are mounted on an insert piece 21 which is inserted in tube casing 1. Insert piece 21 is shaped like a tubular jacket with cross arched bar shaped elements arranged peripherally. As can be seen from FIG. 3, transport racks 12 and support racks 20 are coupled together by bridges or crosspieces 22. At the top and bottom, the thus formed tubular jacket terminates in continuous annular collars 23 and 24, respectively. Top annular collar 23 is chamfered at the outside at 25 so that the inserting of the jacket from the bottom is made easier.

Crosspieces 22, acting as support arms, also provide the necessary radial flexibility for engaging pin 14 in opening 15 of the casing wall. Crosspieces 22 are located in the peripheral tube jacket plane and retreat correspondingly in respect to the serrations which assume an exposed position. They project from the vertical longitudinal edges of the adjoining racks. As can be seen, movable transport racks 12 are practically suspended in a window recess 26. Thus, on both sides there remains only a distance y and at the top a relatively smaller distance y' to the window frame bridged only by crosspieces 22. At the bottom, the end of transport rack 12 is provided with only a small clearance from annular collar 24 at that location. The measure y' takes into consideration the working stroke necessary for effecting movement. Crosspieces 22 engage the corresponding end sections of the support and transport racks. They run at first at a rather acute angle starting from the vertical edge of support rack 20, but then with a distinct bend they engage perpendicularly the corresponding edge of transport rack 12.

Figure 3:
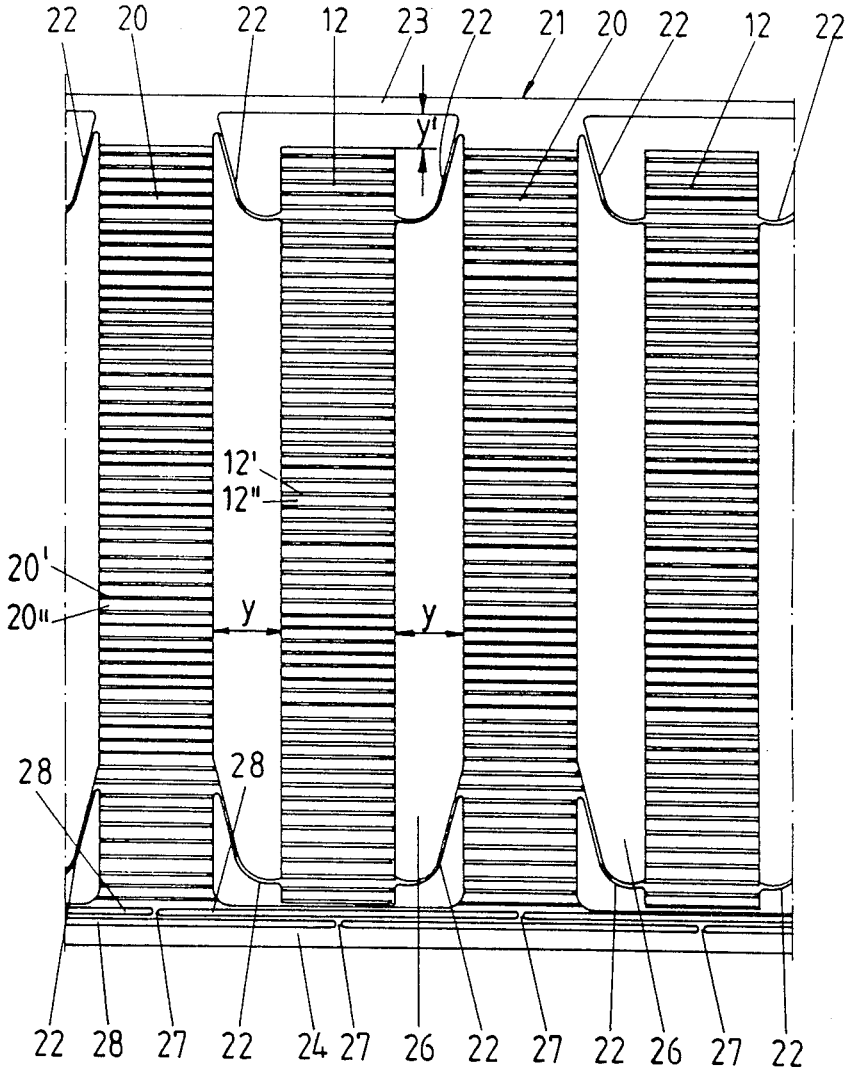
FIG. 3 is an elevational view of the tube jacket shaped insert of the dispenser of FIG. 2 shown in projection.
Figure 4:
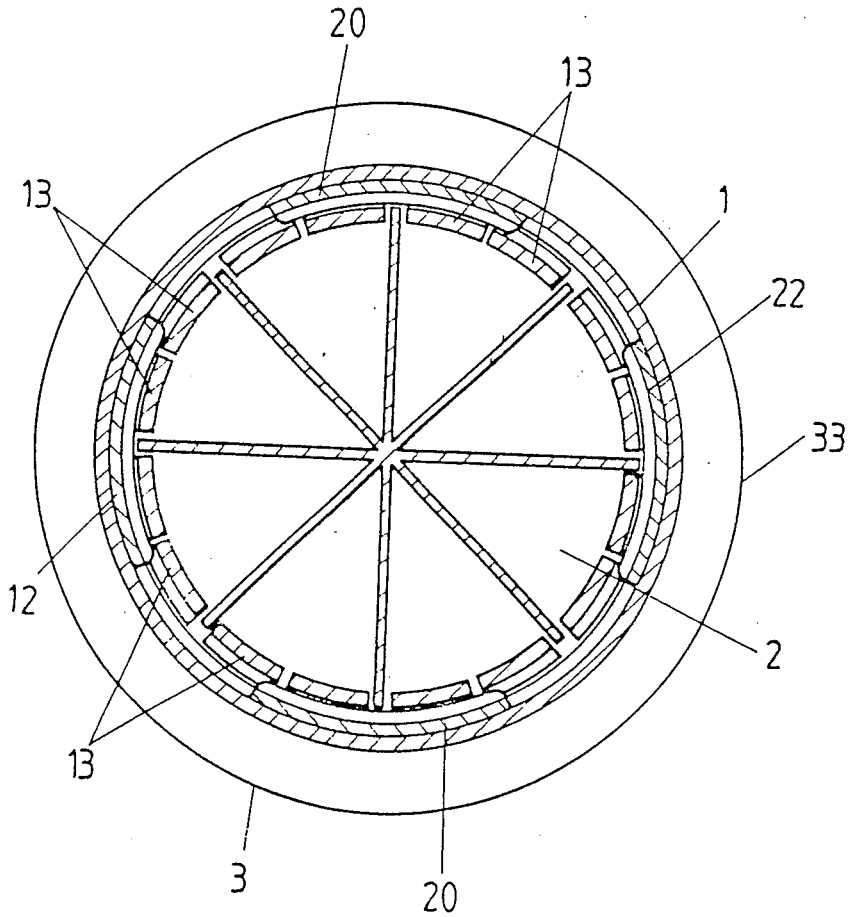
FIG. 4 is a cross-sectional view taken along line IV—IV of FIG. 2.

Crosspieces 22, in addition to fulfilling a coupling function also act as restoring springs, so that after release of operating handle, 3 an at rest position of the mechanism is reestablished. The spring tension for crosspieces 22 is selected so that as transport rack 12 returns from the raised position back to the starting position, it is forced to slide over ratchet teeth 13. Lower annular collar 24, that is the one at the base, is flexibly embodied in the axial direction. This is achieved by peripheral longitudinal slots 28 which are broken by axial bars 27. Viewed in the axial direction, two such longitudinal slots 28 extend one behind the other. Bars 27 are symmetrically arranged with respect to transport racks 12 and couples these symmetrically with respect to support rack 20. In the unstressed mode, the tubular jacket springs back into its starting position as can be seen in FIG. 3. The weight of the discharge substance against it effects a compacting by the length of free play z.

Figure 7:
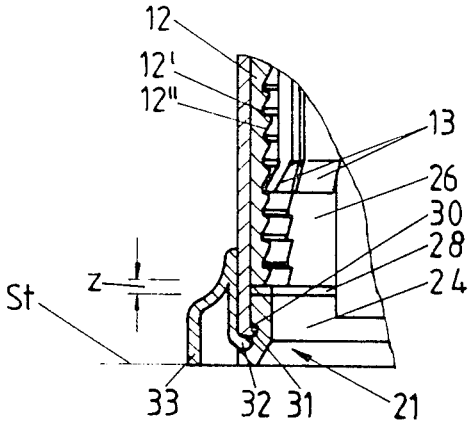
FIG. 7 is a detail view of the bottom section of the dispenser, after the tension relieving downward movement of the pressure bottom in connection with the hereby created suction effect at the discharge opening.

In the normal position, this skeleton structure assumes an angulated position such that the horizontal annular sections lie against the corresponding flanks of the longitudinal slots (FIG. 7).

At each operation the part stroke designated as free play is always traversed first and then begins the stroke section (about two teeth) that effects sliding over support racks 20 of the ratchet and pawl assembly reducing the volume between pressure bottom 2 and cover 4. When the operating handle is released, transport racks 12 withdraw to their starting position sliding under ratchet teeth 13. At the same time, pressure bottom 2 shores up at the "local" support racks 20 by engagement of rachet teeth 30 with steep flanks 20' of support racks 20. When the next ratchet base position is reached, insert piece 21 and pressure bottom 2 shored against it, move down by the distance of the free play described. The tension on substance M is thereby somewhat relieved. This leads to a suction effect which aspirates into bag 9 any possible leftover length of the paste extending from discharge opening 5. In the normal position according to FIG. 2 this effect can not yet be achieved because pressure bottom 2 lies on the base St of the dispenser. It would here have to be shortened or one would have to carry out first a discharge operation.

The lower annular collar 24 of tubular jacket shaped insert piece 21 is embodied as a secure attachment to tube casing 1. For this purpose it has at its surface an annular tee-slot 30 into which an annular bulge 31 of the tube casing engages. For this purpose a slot dimension is selected which is large enough to accommodate even an annular collar 32 of a stationary ring 33 attached to casing tube 1.

Figure 6:
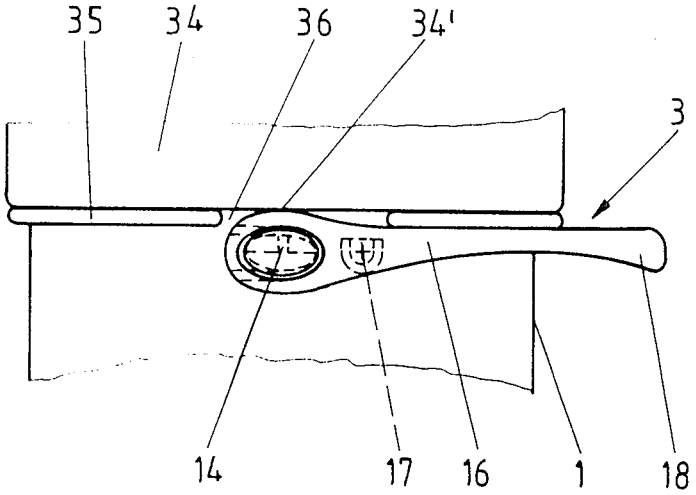
FIG. 6 is a detail view of the dispenser of FIG. 1 showing the area of the operating handle.

The dispenser has a protective cap 34 which covers cover 4 like a dome and is threadably engaged with the upper end of casing tube 1 which has corresponding matching threads. In the screwed on position, lower edge 34' of protective cap 34 overlaps and blocks the free end of prongs 16 of operating handle 3, so that the dispenser with properly screwed on protective cap 34 is locked against discharge. The screw-on stop is formed by an annular collar 35 which forms a penetration 36 creating a passing space for the shorter lever arm in the region of operating handle 3, as clearly seen in FIG. 6.

While only a single embodiment of the present invention has been shown and described, it will be obvious that many changes and modifications may be made thereunto without departing from the spirit and scope of the invention.

What is claimed is:

1. A dispenser for dispensing unit doses of a substance, such as tablets, pastes and the like, comprising:

a tubular shaped casing housing a bag therein containing the discharge substance and having a discharge opening at a first end;

a pressure bottom at a second end of said tubular casing opposite said first end for the displacement of the discharge substance in the direction of the discharge opening;

an actuating member positioned near the discharge opening;

a pair of oppositely arranged transport racks disposed along an inner wall of said casing operatively connected to said actuating member so as to be longitudinally displaceable, said racks including ratchet teeth which operatively engage the pressure bottom so as to move the pressure bottom stepwise in the direction of the discharge opening by the action of said actuating member;

a pair of support racks located along the inner wall of said tubular casing, said support racks incuding ratchet teeth for preventing backwards movement of said pressure bottom;

said support racks and said transport racks being disposed in alternating relationship circumferentially about said inner wall of said tubular casing and mounted on an insert piece which can be inserted into and fixed within said tubular casing; and said pressure bottom directly engaging simultaneously the ratchet teeth of said transport racks and the ratchet teeth of said support racks.

2. The dispenser according to claim 1, wherein adjacent transport and support racks are connected together by crosspieces.

3. The dispenser according to claim 1, wherein said cross pieces are formed as restoring springs for said transport racks.

4. The dispenser as defined in claim 1, wherein said support racks are mounted on said insert piece so as to be resiliently supported and capable of a slight displacement in said tubular casing in a direction opposite said discharge opening so that upon release of said actuating member after discharge, the support racks and transport racks are adapted to elastically recoil in a direction opposite to the discharge opening due to the weight of the substance in the bag thereby causing a suction effect on the substance and aspiration into the bag.

5. The dispenser as defined in claim 4, wherein said insert piece includes a lower annular collar fixedly secured to said tubular casing, said support racks being mounted to said annular collar and said annular collar being provided with peripheral weakening slots therein aligned with said support racks.

* * * * *